US009354004B2

(12) United States Patent
Brubaker et al.

(10) Patent No.: US 9,354,004 B2
(45) Date of Patent: May 31, 2016

(54) CHARGING HANDLE STRAP

(71) Applicant: Locan Properties, LLC., Columbia Falls, MT (US)

(72) Inventors: Barry Lee Brubaker, Kalispell, MT (US); Gary Byers, Columbia Falls, MT (US)

(73) Assignee: Locan Properties LLC, Columbia Falls, MT (US)

( * ) Notice: Subject to any disclaimer, the term of this patent is extended or adjusted under 35 U.S.C. 154(b) by 0 days.

(21) Appl. No.: 14/638,727

(22) Filed: Mar. 4, 2015

(65) Prior Publication Data

US 2015/0253105 A1 Sep. 10, 2015

Related U.S. Application Data

(60) Provisional application No. 61/947,705, filed on Mar. 4, 2012, provisional application No. 62/007,755, filed on Jun. 4, 2014, provisional application No. 62/063,851, filed on Oct. 14, 2014.

(51) Int. Cl.

| | |
|---|---|
| ***F41A 3/72*** | (2006.01) |
| ***F41A 19/00*** | (2006.01) |
| ***F41A 35/06*** | (2006.01) |

(52) U.S. Cl.

CPC .. *F41A 3/72* (2013.01); *F41A 35/06* (2013.01)

(58) Field of Classification Search

CPC ..... F41A 33/06; F41A 35/00; F41A 35/06; F41A 3/72; F41A 19/00; F41A 19/34; F41A 19/37; F41A 19/47; F41A 19/50; F41A 19/52; F41A 7/00; F41A 7/02; F41A 7/04; F41A 7/06

USPC ..... 89/1.4, 1.42

See application file for complete search history.

(56) References Cited

U.S. PATENT DOCUMENTS

| | | | | |
|---|---|---|---|---|
| 4,807,512 | A * | 2/1989 | Johansson | F41A 3/72 89/1.4 |
| 8,104,393 | B2 | 1/2012 | Kincel | |
| 8,567,301 | B1 | 10/2013 | Sharron | |
| 8,820,210 | B2 | 9/2014 | Melville | |
| 8,887,612 | B2 | 11/2014 | Bayly | |
| 8,960,066 | B2 | 2/2015 | Gomez | |
| 2014/0060293 | A1 * | 3/2014 | Gomez | F41A 3/72 89/1.4 |
| 2015/0233663 | A1 * | 8/2015 | Kiehn | F41C 33/001 42/90 |

* cited by examiner

*Primary Examiner* — Bret Hayes
*Assistant Examiner* — Derrick Morgan
(74) *Attorney, Agent, or Firm* — Jean Kyle

(57) ABSTRACT

A strap engages the T-shaped end of a charging handle of an AR platform rifle to enhance accessibility of that handle. A first ring captures one arm of the T-shaped end and engages the security latch. A second ring captures the other arm of the T-shaped end. A loop or handle attaches to the rings and is pulled by the shooter to charge the rifle.

12 Claims, 8 Drawing Sheets

CHARGING HANDLE STRAP

CROSS-REFERENCE TO RELATED APPLICATIONS

This application claims the benefits of U.S. Provisional Application No. 61/947,705, filed Mar. 4, 2014, and U.S. Provisional Application No. 62/007,755, filed Jun. 4, 2014, and U.S. Provisional Application No. 62/063,851, filed Oct. 14, 2014, the disclosures of which are hereby incorporated by reference in their entirety including all figures, tables and drawings.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Automatic and semi-automatic rifles are a staple for the military, security forces, law enforcement, and civilians. They have also become popular with sportsmen using modern sporting rifles (MSR). These rifles are charged with a charging handle. Standard charging handles can be difficult to access by some shooters. A latch on the handle must be pulled to release the handle. This latch can be off side and awkward to access for a left-handed shooter. A scope mounted on the rifle limits access to the charging handle by reducing the space above the handle. Finally, a gloved hand often lacks the dexterity and tactile strength to pull a charging handle.

To address these issues, manufacturers have provided a variety of styles of charging handles. There are handles that are configured for a left-handed shooter (U.S. Pat. No. 8,960,066). Additionally, ambidextrous handles have been created (U.S. Pat. No. 8,887,612). Extended and oversized latches can be added to standard handles to make the latches more accessible (U.S. Pat. Nos. 8,820,210; 8,567,301 and 8,104,393). These solutions however require that the handle be altered or replaced. A need remains for an effective solution to charging handle accessibility that does not require such material alteration to the rifle.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention is a strap that surrounds the charging handle of an AR platform rifle. A first ring slips over one arm of the T-shaped end of a charging handle while a second ring slips over the other arm of the T. The first ring surrounds not only the arm of the T but also surrounds and engages the latch of the charging handle. A draw means attached to the rings is accessed by the user to pull the charging handle and charge the rifle.

DETAILED DESCRIPTION OF THE INVENTION

Figure 1:
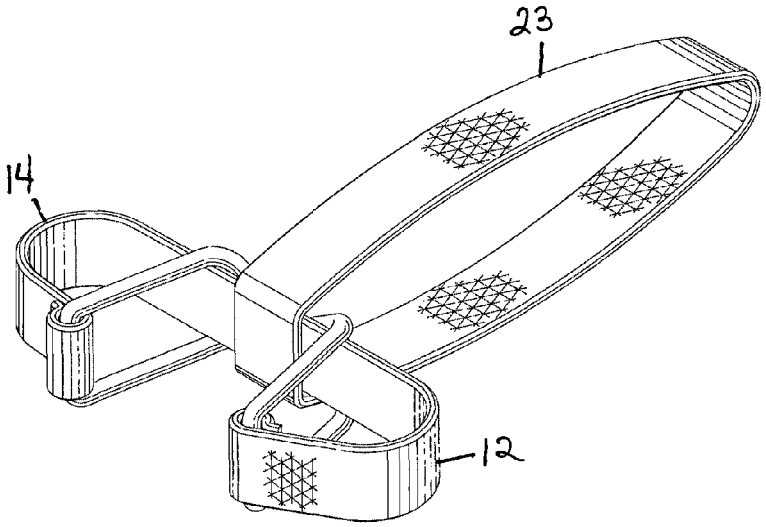
FIG. 1 is a top perspective view of a preferred embodiment of the strap of the subject invention.

The subject invention involves a strap that surrounds the end of a charging handle of an AR platform rifle. The strap presents a loop or handle to the shooter that provides the shooter a simpler more accessible means to charge the rifle.

The strap 10 of the subject invention has a first ring 12 and a second ring 14 that surround the arms 16, 18 of a T-shaped end of a charging handle 20 as well as the security latch 22. The rings are connected to a draw means 23 that the shooter pulls to charge the rifle. The rings of the strap must be configured to deform to surround the arms of the T, yet they must be rigid enough to provide adequate strength to move the handle. The draw means likewise can be flexible to accommodate a variety of sizes of pulling fingers, or thumbs, but must be stable enough to provide a consistent, reliable pull. The strap therefore can be made of a variety of, and a combination of, materials that provide the deformation properties required by the rings and the stability required by the draw means. In one exemplified embodiment, these properties are provided by nylon wedding and nylon cord. In another exemplified embodiment, the strap is made of plastic.

Figure 2:
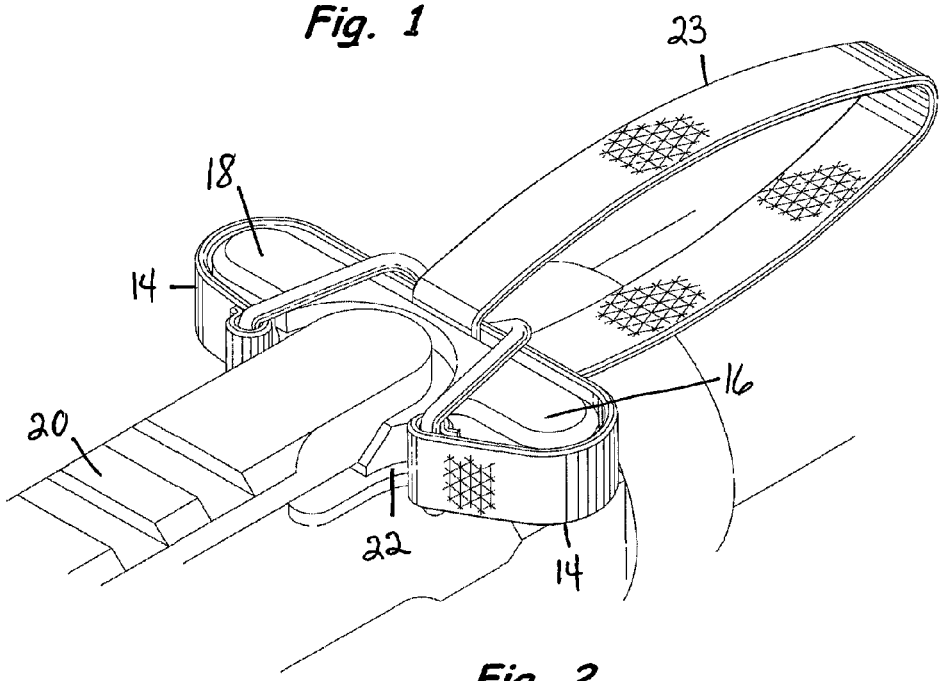
FIG. 2 is a view of the embodiment shown in FIG. 1 on a rifle.
Figure 3:
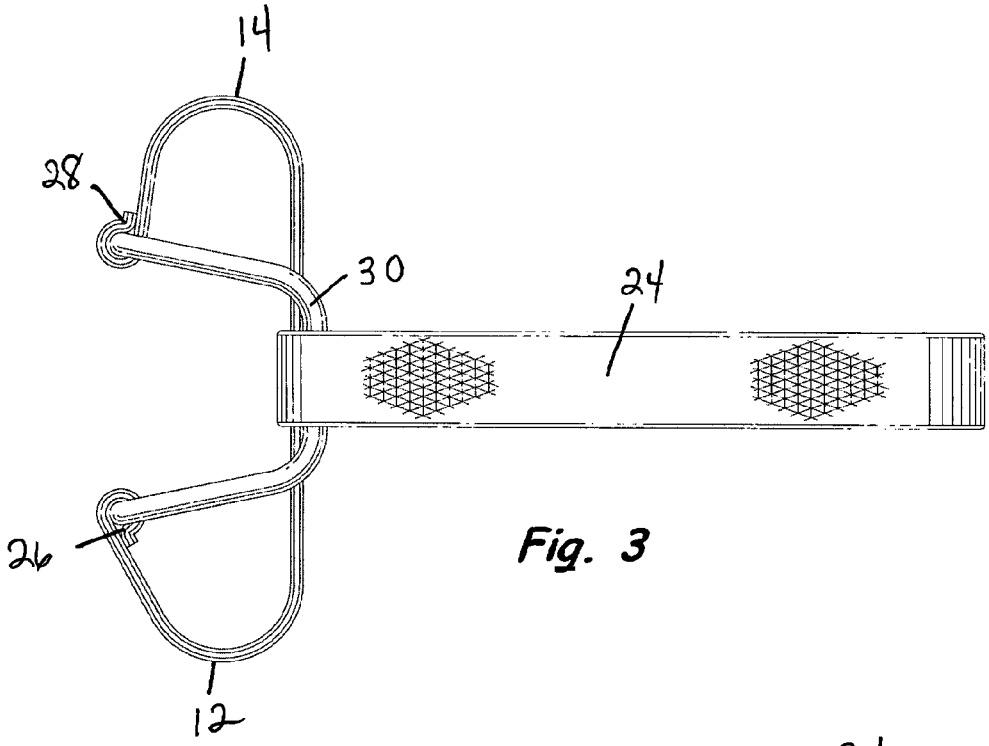
FIG. 3 is a top plan view of the preferred embodiment shown in FIG. 1.
Figure 4:
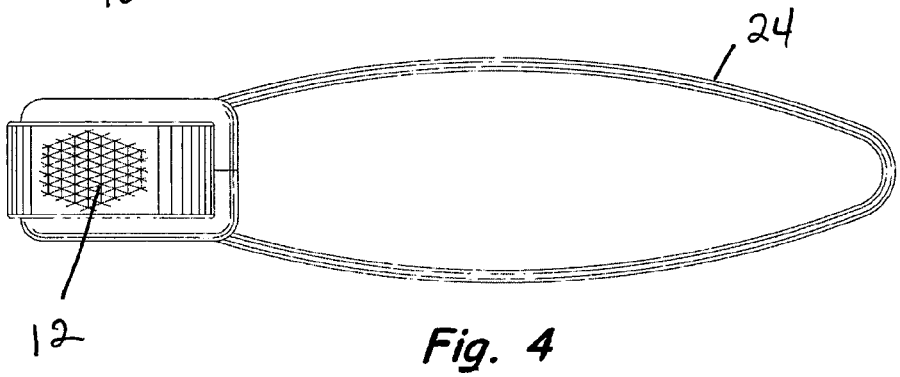
FIG. 4 is a side elevational view of the preferred embodiment shown in FIG. 1.
Figure 5:
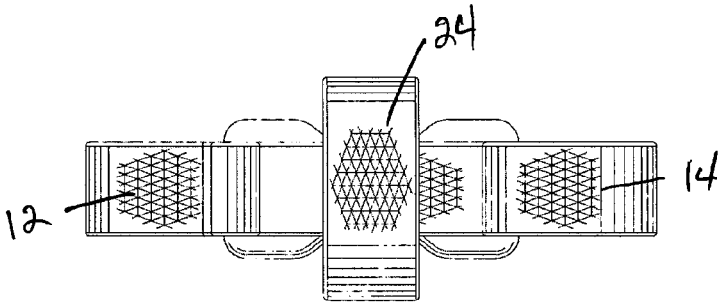
FIG. 5 is a rear elevational view of the preferred embodiment shown in FIG. 1.
Figure 6:
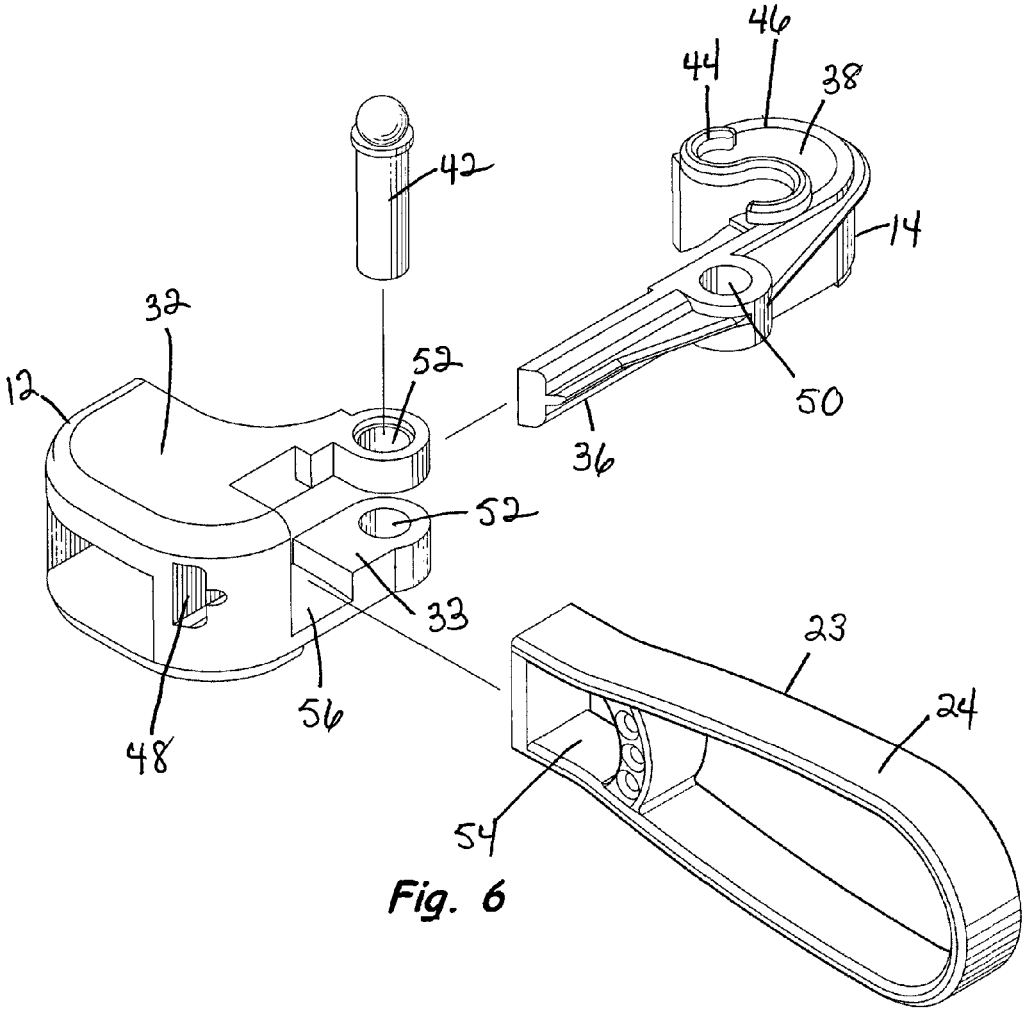
FIG. 6 is an exploded top perspective view of another preferred embodiment of the strap of the subject invention.
Figure 7:
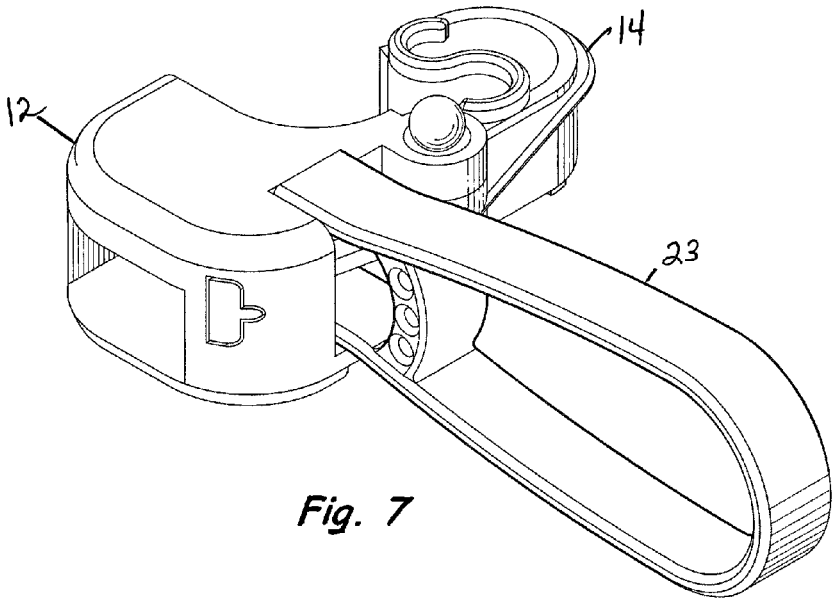
FIG. 7 is a top perspective view of the preferred embodiment shown in FIG. 6.
Figure 8:
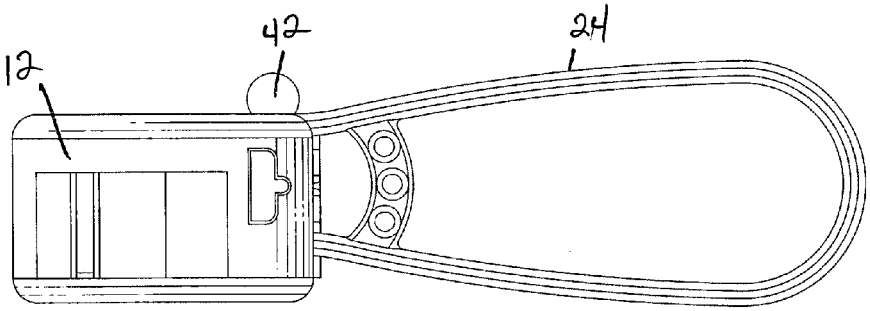
FIG. 8 is a side elevational view of the preferred embodiment shown in FIG. 6.
Figure 10:
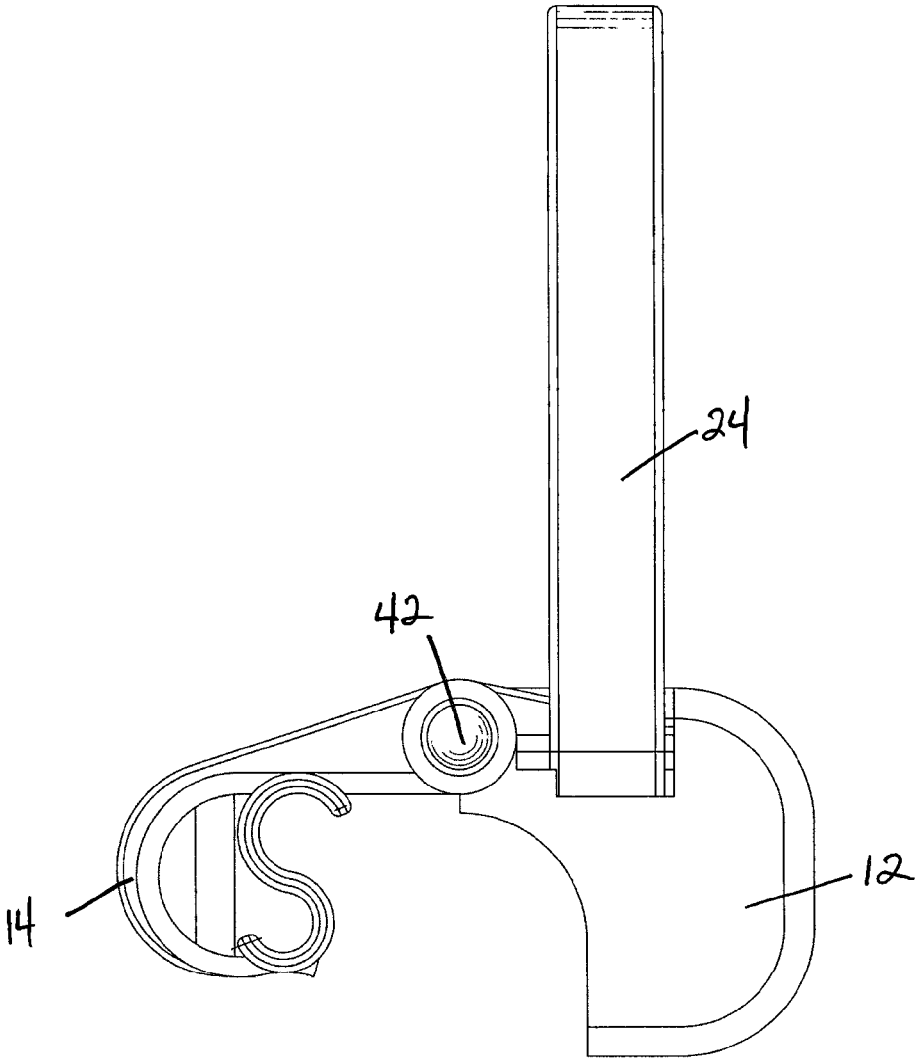
FIG. 10 is a top plan view of the preferred embodiment shown in FIG. 6.
Figure 9:
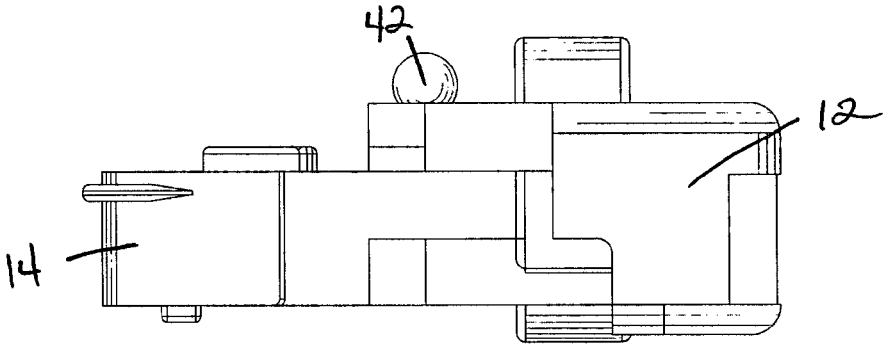
FIG. 9 is a front elevational view of the preferred embodiment shown in FIG. 6.
Figure 11:
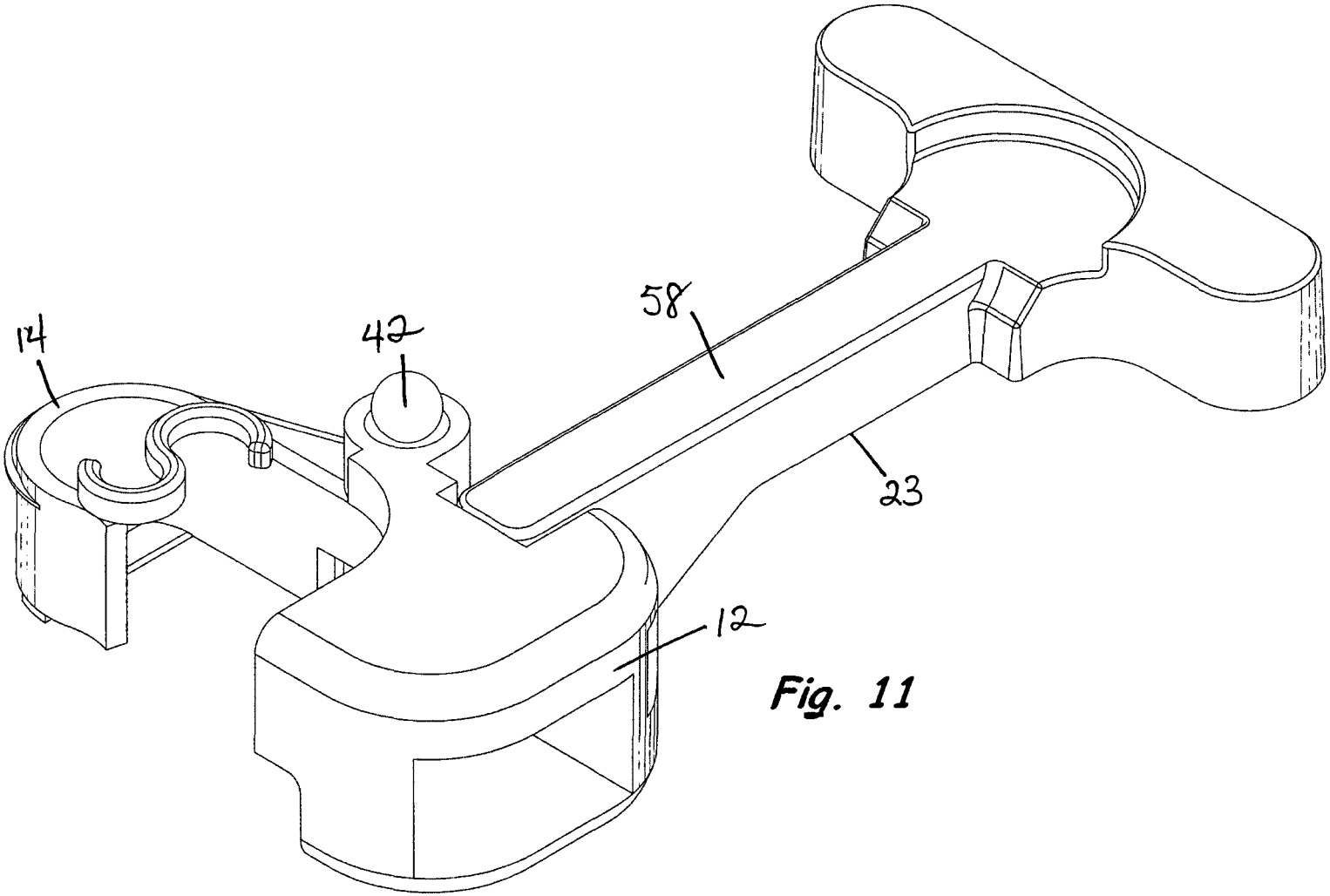
FIG. 11 is a perspective view of the embodiment shown in FIG. 6 where the loop has been replaced by a T-shaped handle.
Figure 13:
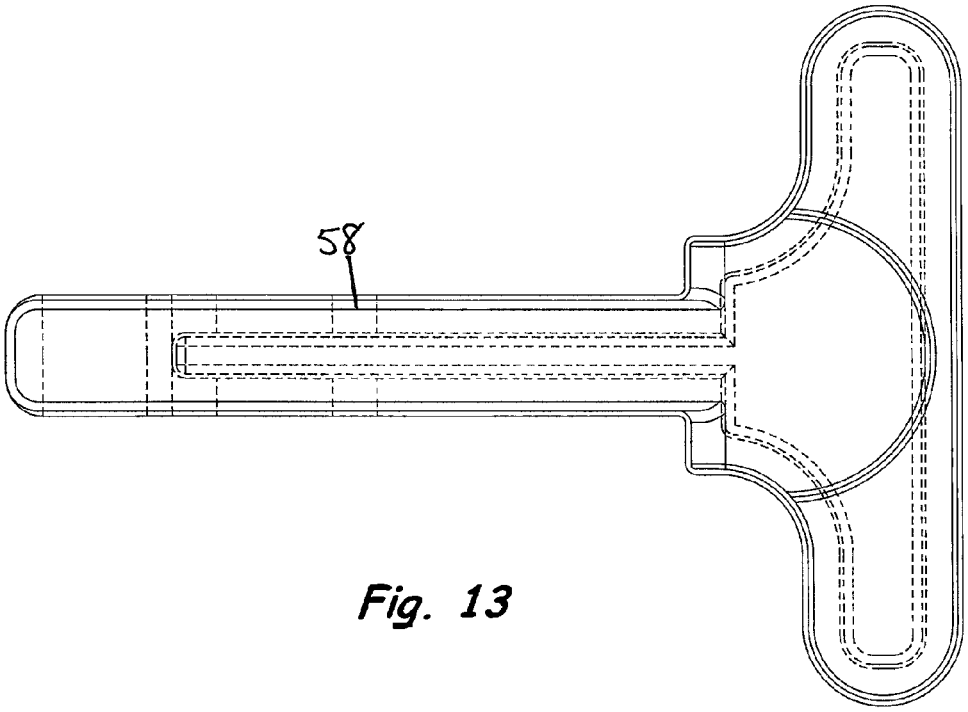
FIG. 13 is a top view of the T-shaped handle shown in FIG. 11.
Figure 12:
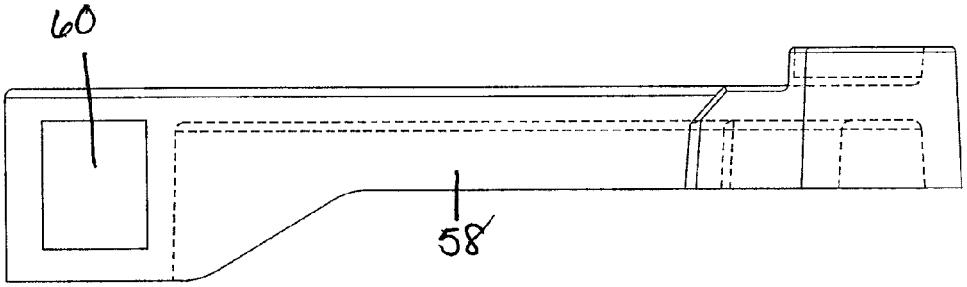
FIG. 12 is a side view of the T-shaped handle shown in FIG. 11.

A preferred embodiment is shown in FIGS. 1-5. In this embodiment, a single strip of nylon webbing creates the rings. A first ring 12 surrounds and captures one arm 16 of the T-shaped end of the charging handle as well as surrounds and engages the security latch 22. A second ring 14 surrounds and captures the other arm 18 of the T-shaped end of the charging handle 20. In this embodiment, the rings are created by drawing the ends of the single piece of webbing toward one another. Hems 26, 28 sewn into each end of the webbing hold a cord 30 that is used to draw the ends together. The cord is fastened to the middle of the piece of webbing. The cord further acts to capture and hold the arms of the T-shaped end of the handle being positioned on top and on the bottom of the handle so the rings cannot slip from around the arms (FIG. 2). In this embodiment, the cord bends the webbing at its center and flexes to surround the arms.

In this exemplified embodiment, the draw means 23 is a loop 24 also made of nylon webbing. Nylon webbing is flexible yet strong. It is not effected by water, is lightweight, inexpensive, and durable. One skilled in the art however would recognize that each component of this invention could be made of other suitable materials. For example, aluminum strapping could provide enough flex to form the rings. Plastics or composites could also provide the required flex to form the rings. Likewise, the loop can be made of any of these materials. In the exemplified embodiment, the loop is attached to the middle of the single piece of nylon webbing that forms the rings. The cord forming the rings run through the center of the loop. Thus, the loop not only pulls the rings back from the center of the webbing but provides pressure on the cord at the end of the ring through the cord. This insures that not only is the handle secured but adequate pull is applied to the security latch to release the handle.

This exemplified embodiment is convenient in that it is easily applied and removed. In a particularly preferred embodiment, orange stitching is applied to the ring that goes over the security latch to insure proper application of the strap to the rifle. The strap is small, compressible, and lightweight enough to store in a pocket. Further, the strap has a low profile that works well on a rifle with a scope. Applicant notes however that there are other means by which to configure the strap and achieve the same results. For example, the rings need not be formed by a single piece of material but could independently engage the loop. The rings could be sleeves that encase the arms of the T-shaped end of the handle replacing the function of the cord. Further modifications would be apparent to those skilled in the art. The strap of the subject invention is unique in that it provides accessibility of the charging handle of a AR platform rifle without having to modify the rifle. No other device provides this alternative.

FIGS. 6-14 show another preferred embodiment of the strap of the subject invention. In this embodiment, strap pieces are made of a high impact polymer. The first ring 12 that surrounds and captures the one arm 16 of the charging handle as well as the security latch 22 is cup-like. A top 32 of the cup holds it on the arm. In this embodiment, the cup-like first ring connects the three pieces of the strap, the first ring, the second ring, and the draw means together. The cup of the first ring has an aperture that receives the shaft of the hook of the second ring. The shaft passes through an open end of the loop draw means and a pin connects the pieces together. Each piece is configured to be molded of plastic. One skilled in the art would recognize how these pieces are configured for molding and would understand that similar pieces could be made of other materials to achieve the object of the invention.

The second ring 14 is a hook 38 on the end of a shaft 36. The hook has a bar 44 on top 46 to capture and hold the arm 18 of the charging handle within the hook. In the exemplified embodiment, the bar is a fanciful S shape. The bar however can be any shape that effectively holds the hook in place over the arm. The shaft 36 of the hook is T shaped and fits into an aperture 48 in the wall of the first ring cup 12. The shaft also has a opening 50 that sits between openings 52 on the top 32 and the bottom 33 cup of the first ring through which the pin 42 is threaded. One end 54 of the draw means 23, a loop 24 in FIG. 6-10, fits into a slot 56 in the first ring which positions it so the shaft passes through the slot before the three pieces are secured by the pin. This means of securing the three pieces of this embodiment together provides a rigid connection between the first and second ring that securely holds the draw means as it is pulled. It would be apparent to one skilled in the art that there are other means by which to connect the pieces that are equally effective and provide the strength necessary to pull the charging handle of the rifle.

Figure 14:
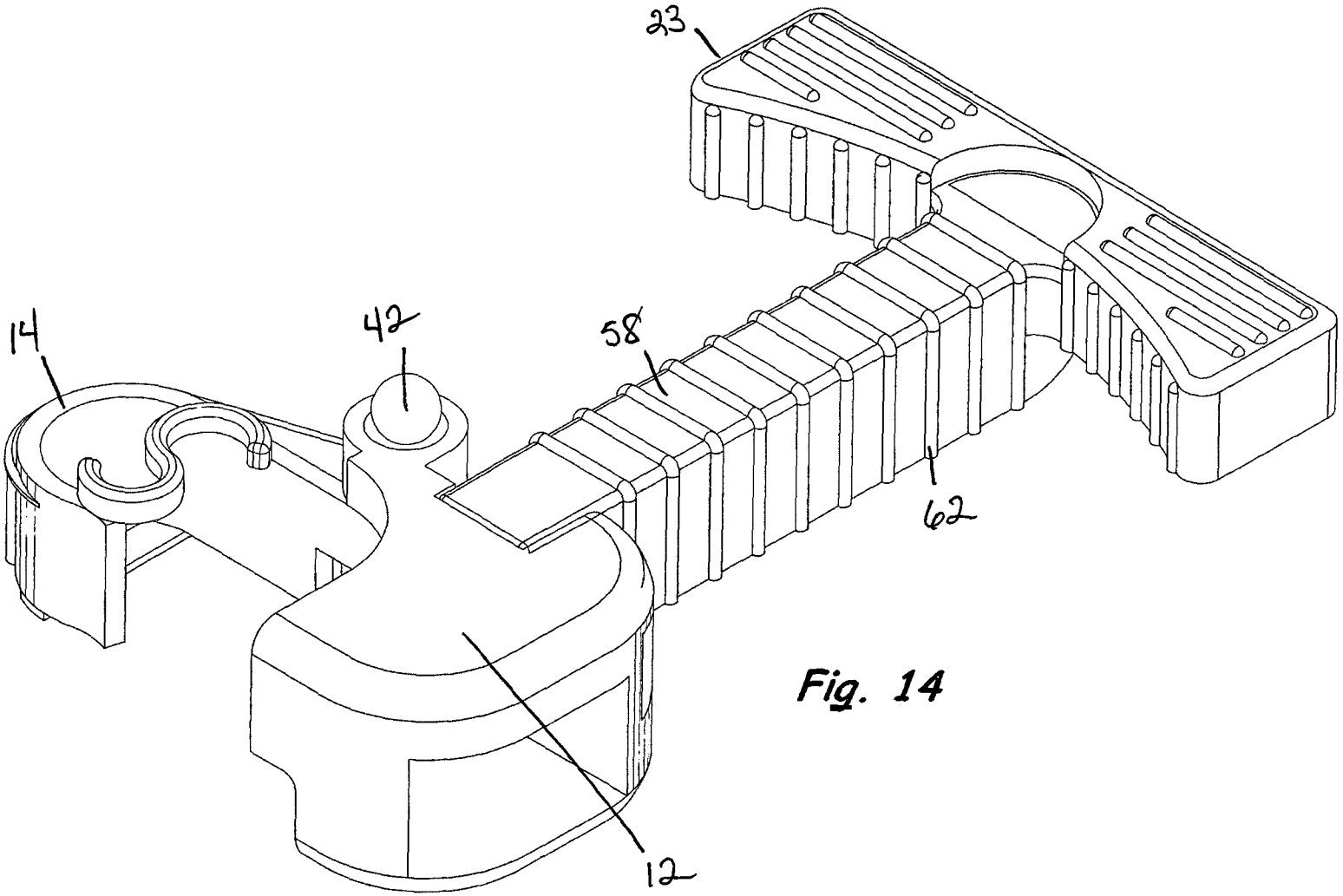
FIG. 14 is an alternative embodiment of the T-shaped handle shown in FIG. 11.

In an alternative embodiment, the loop of the draw means is replaced by a T-shaped handle 58 as shown in FIGS. 11-14. The T-shaped handle 58 fits into the slot 56 in the first ring cup. The shaft of the second ring passes through an open end 60 in the T-shaped handle and all three pieces of the strap are secured by the pin 42. The T-shaped handle offers the shooter an alternative to the loop to assist the shooter in charging the rifle. The T-shaped handle is more familiar to the shooter because it is the shape of the charging handle. Use of the T-shaped handle on the strap of the subject invention is not limited by hand size or the dexterity that may be required by placing the finger in a loop. FIG. 14 shows that texture 62 can be added to the T-shaped handle to increase grip when it is wet and cold.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A strap to engage a T-shaped charging handle on a rifle comprising:

a first ring capable of capturing a first arm of the T-shaped handle and a security latch of the T-shaped handle;

a second ring connected to the first ring capable of capturing a second arm of the T-shaped handle;

draw means connected to the first ring and the second ring;

wherein the draw means is pulled to release the security latch and draw the charging handle to charge the rifle;

wherein said first ring, said second ring, and said draw means are independent, interconnecting pieces; and wherein said first ring is cup-like, said second ring is a hook on a shaft, and said draw means has an open end, wherein to interconnect the pieces, the open end of the draw means is inserted into a slot in said first ring cup, the shaft of said second ring is inserted through the open end of the draw means into an aperture in the first ring cup, and said first ring, said second ring, and said draw means are secured to one another.

2. The strap of claim 1, wherein said draw means is a loop.

3. The strap of claim 1, wherein said draw means is a T-shaped handle.

4. The strap of claim 1, further comprising an indicator to mark said first ring.

5. The strap of claim 1, wherein said draw means is a loop.

6. The strap of claim 1, wherein said draw means is a T-shaped handle.

7. The strap of claim 1, wherein said first ring, said second ring, and said draw means are secured to one another by a pin.

8. The strap of claim 7, wherein said first ring cup has a top and a bottom and matching openings are disposed in the top and the bottom of the first ring cup and outside said slot, said second ring further comprising an opening, wherein the opening in the top of said first ring cup, the opening in the bottom of said first ring cup, and the opening in said shaft of said second ring align to receive the pin.

9. A strap to engage a T-shaped charging handle on a rifle comprising:

a first ring capable of capturing a first arm of the T-shaped handle and a security latch of the T-shaped handle, the first ring cup-like having a top and a bottom, an aperture in the cup-like first ring, a slot in the cup-like first ring and matching openings in the top of the cup-like ring and the bottom of the cup-like ring;

a second ring capable of capturing a second arm of the T-shaped handle, the second ring a hook on a shaft, an opening on the shaft of the second ring; and draw means having an open end;

wherein the first ring, the second ring, and the draw means are interconnected when the open end of the draw means is inserted into the slot in the cup-like first ring, the shaft of the second ring is inserted through the open end of the draw means into the aperture in the cup-like first ring, and the opening in the top of the cup-like first ring, the opening in the bottom of cup-like first ring cup, and the opening in the shaft of the second ring align to receive a pin, and wherein the draw means is pulled to release the security latch and draw the charging handle to charge the rifle.

10. The strap of claim 7, wherein said draw means is a loop.

11. The strap of claim 9, wherein said draw means is a T-shaped handle.

12. The strap of claim 9, further comprising a bar over said hook of said second ring.

* * * * *